US005119948A

United States Patent [19]

Hallgrimsson

[11] Patent Number: 5,119,948

[45] Date of Patent: Jun. 9, 1992

[54] SEISMIC SHELF GUARD

[75] Inventor: Bjarki H. Hallgrimsson, Mountain View, Calif.

[73] Assignee: The Board of Trustees of the Leland Stanford Junior University, Stanford, Calif.

[21] Appl. No.: 626,899

[22] Filed: Dec. 13, 1990

[51] Int. Cl.[5] ..... A47F 7/00

[52] U.S. Cl. ..... 211/183; 211/42; 211/105.1

[58] Field of Search ..... 211/183, 105.1, 42, 211/100, 101, 96, 171; 248/240.4, 242

[56] References Cited

U.S. PATENT DOCUMENTS

| | | | |
|---|---|---|---|
| 818,083 | 4/1906 | Ellett et al. | 211/183 X |
| 1,217,973 | 3/1917 | Mann | 211/183 |
| 1,923,096 | 8/1933 | Keely et al. | 211/42 X |
| 2,118,151 | 5/1938 | Brockway | 211/42 X |
| 2,597,115 | 5/1952 | Lundstrum | 211/100 |
| 3,167,037 | 1/1965 | Mapson | 248/242 X |

*Primary Examiner*—David M. Purol
*Assistant Examiner*—Sarah A. Lechok
*Attorney, Agent, or Firm*—Townsend and Townsend

[57] ABSTRACT

A shelf guard for use with bookshelves and the like includes first and second stationary support brackets and first and second linkages pivotally attached to the support bracket. The linkages and a retention bar supported thereon are pivotal to a raised position thereby permitting access to a guarded shelf and are pivotable to a lowered position for preventing items from falling from the shelf.

18 Claims, 1 Drawing Sheet

SEISMIC SHELF GUARD

BACKGROUND OF THE INVENTION

This invention relates generally to guard devices for retaining shelved items, and more particularly the invention relates to a variably positionable guard which can be seismically actuated to a retaining position.

Items stacked on shelves pose a hazard to humans during an earthquake, and the items can suffer damage in falling from the shelves. This is a especially true in library stacks. The conventional shelf configuration used in major library stack systems consists of steel uprights with perforated slots at a standard vertical spacing. Steel shelves are attached to the uprights via hooks that protrude from the shelves and mate into the slotted holes in the uprights. This configuration allows rapid adjustment of shelf height according to variation in book geometry. Books falling from the shelves can cause bodily harm and can result in blocking of exists. Further, considerable time and effort is required in re-shelving the books after an earthquake, and many books require re-binding due to damage from falling.

The present invention is directed to a novel shelf guard which is positionable either manually or by seismic action so as not to interfere with use of the shelves during normal times but which is positioned either manually or by seismic action to prevent shelved items from falling.

SUMMARY OF THE INVENTION

Accordingly, an object of the invention is a seismic actuated shelf guard.

Another object of the invention is a shelf guard which can be positioned so as not to interfere with normal use of the shelf.

Briefly, the shelf guard in accordance with a preferred embodiment of the invention comprises two support brackets having slots therein and two linkages which are pivotally attached to the support brackets by means of pins which extend from the linkages into the slots. A retention bar extends from the two linkages across a bookshelf. The linkages and retention bar can be pivoted on the pins to a raised position where the retention bar does not interfere with removal of items from the shelf and to a lowered position where the retention bar prevents shelved items from falling from the shelf.

In accordance with a feature of the invention a stopper member extends from at least one linkage and engages a front edge of a support bracket when the linkages are in the raised position with the pins slid backwards in the slots. In this position the linkages should be at least horizontal or slightly above horizontal. Manual force or seismic shaking causes the linkage pin to slide forward in the slots and the stopper member disengages the front edge of the support bracket, whereupon the retention bar falls to the lowered position. Catcher members on the support brackets support the linkages when in the lowered position.

The invention and objects and features thereof will be more readily apparent from the following detailed description and appended claims when taken with the drawing.

DETAILED DESCRIPTION OF ILLUSTRATIVE EMBODIMENT

Figure 1:
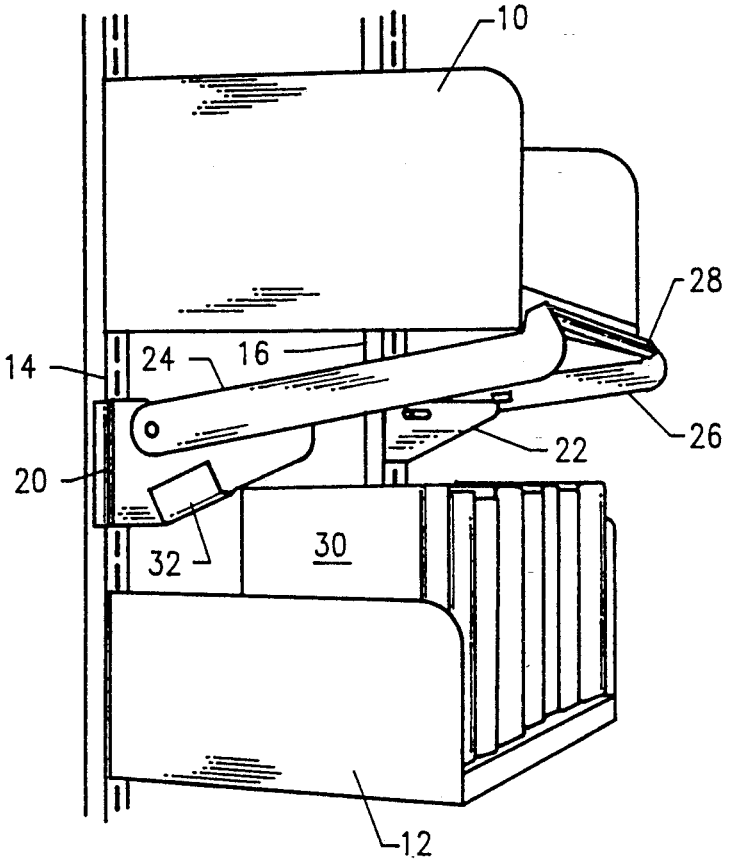
FIG. 1 is a perspective view of a shelf guard in accordance with one embodiment of the invention.

Referring now to the drawing, FIG. 1 is a perspective view of a conventional bookshelf arrangement with a shelf guard in accordance with one embodiment of the invention. The shelves 10, 12 are attached to upright members 14, 16 via hooks that protrude from the shelves and mate in slotted holes in the uprights. As will be appreciated, other fastening arrangements can be employed, and the bookshelves can be wood rather than metal.

The shelf guard comprises first and second stationary support brackets 20, 22 which are fastened to the uprights 14, 16 via hooks similar to the attachment of the shelves 10 and 12 to the uprights. A pair of linkages 24, 26 are pivotally attached to the stationary support brackets 20, 22 with a retention bar 28 attached to and extending from the linkages across the front of a shelf. The retention bar can be steel tubing for example, or the linkages and bar can be an integral body. The linkages and retention bar can be moved to a raised position where the retention bar is aligned with the front lip of the upper shelf 10. In this position books 30 or other items can be readily placed on and removed from the shelf 12. The linkages and retention bar can be moved to a lowered position where the retention bar prevents items on shelf 12 from falling therefrom. In the lowered position the linkages 24, 26 engage catcher members 32 which extend from the support brackets.

Figure 2:
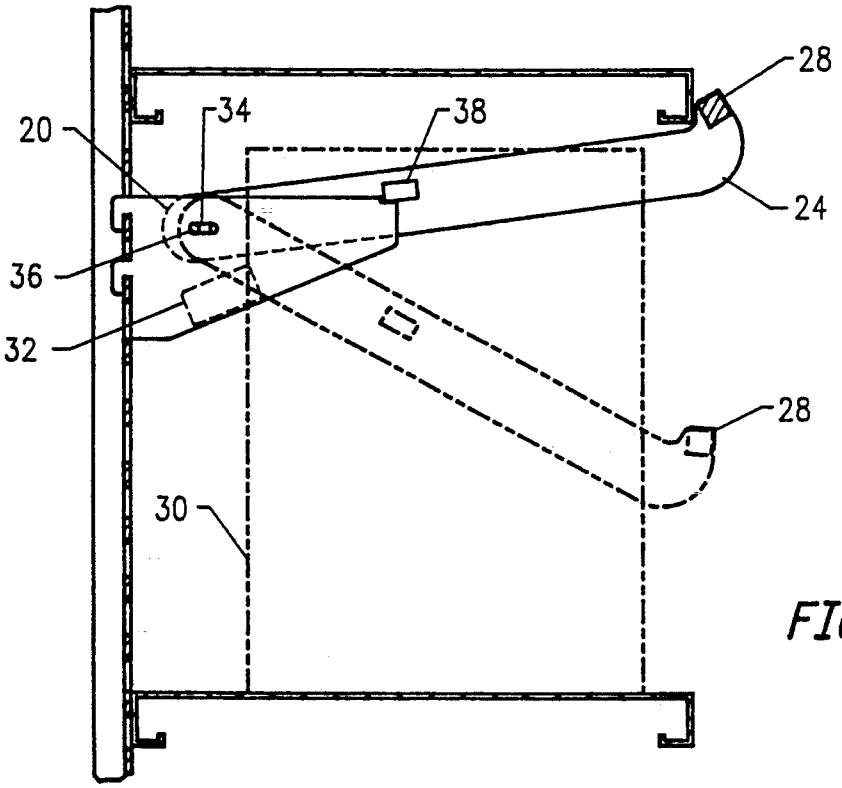
FIG. 2 is a side view illustrating operation of the shelf guard of FIG. 1.

FIG. 2 is a side view of the shelf guard of FIG. 1 and further illustrates operation thereof. The support bracket 20 has a slot 34 therein, and a pin 36 extends from linkage 24 and slidable engages slot 34. With linkage 24 in the raised position and pin 36 slid backwards in slot 34, a stopper member 38 extending from linkage 24 engages a front edge of the stationary support bracket 20 thereby maintaining the linkage in the upper position with the retention bar 28 aligned with the front lip of the upper shelf. The linkage can be manually pulled forward with the pin 36 moves forward in the slot 34 whereupon the stopper member 38 is released from the front edge of bracket 20, and the linkage and retention bar moves to a lower position shown by dotted line. In the lower position the linkage bar 28 prevents books and other items on the shelf from falling. The catcher member 32 limits the travel of linkage 24 in the lower position. Gravity keeps linkage 24 in the lowered position, but the linkage could be actively engaged by catcher member 32.

The shelf guard has been tested in a full scale configuration using a sinusoidal shaking table at the Bloom Engineering Earthquake Center at Stanford University. The retention system triggered before books were able to fall from the shelves with an onset acceleration of approximately 0.007 g. The system did not have a problem with inadvertent release at this triggering level. The system was further tested to extreme and prolonged effect of inertial loading without any damage to books or the retention system.

Either manual force or violent shaking as in the case of a major earthquake will dislodge the retention bar.

This is due to the inertial loading on the retention bar linkage which causes the linkage to slide forward in the slotted holes, whereupon the stopper member jumps over the edge of the support bracket. The downward travel of the retention linkage is limited by the catcher members on the supports brackets.

A shelf guard in accordance with the invention can be readily used in other applications such as in assuring that hazardous materials do not fall from shelves and in transportation such as on ships. For these applications the device need not be self triggering since it would most likely be lowered in the normal configuration and only moved to a raised position in order to gain access to the items on the shelf. Further, the shelf guard readily lends itself to diecast metal parts or injection molded plastic parts. Additionally, the guard can be attached in many ways including direct attachment to adjacent shelves.

Thus, while the invention has been described with reference to a specific embodiment, the description is illustrative of the invention and is not to be construed as limiting the invention. Various modifications and applications may occur to those skilled in the art without departing from the true spirit and scope of the invention as defined by the appended claims.

I claim:

1. A guard for a shelf comprising first and second stationary support brackets, first and second linkages each slidably and pivotally attached to a support bracket, and a retention bar extending from said linkages across the front of said shelf, said linkages and retention bar being pivotable to a raised position thereby permitting access to said shelf and being pivotable to a lowered position for preventing items from falling from said shelf.

2. The guard as defined by claim 1 and further including means for releasably maintaining said linkages and said retention bar in a raised position, and means for supporting said linkages and said retention bar in said lowered position.

3. The guard as defined by claim 2 wherein said means for releasably maintaining said linkages and said retention bar in a raised position includes a stopper member extending from at least one linkage which engages a front edge of a stationary support bracket when in said raised position.

4. The guard as defined by claim 3 wherein said means for supporting said linkage and said retention bar in said lowered position includes at least one catcher member extending from at least one of said stationary support brackets.

5. The guard as defined by claim 2 wherein said means for supporting said linkages and said retention bar in said lowered position includes at least one catcher member extending from at least one of said stationary support brackets.

6. The guard as defined by claim 1 wherein said linkages and said retention bar comprises one integral body.

7. The guard as defined by claim 1 wherein said linkages and said retention bar are separate elements.

8. A shelf guard comprising first and second stationary support brackets, each support bracket having a slot, a front edge, and a catcher member extending therefrom, first and second linkages, each linkage being pivotally attached to one of said support brackets by a pin extending from the linkage and extending into said slot of said support bracket, at least one linkage having a stopper member extending therefrom for engaging a front edge of one of said support brackets when said linkages are in a raised position with said pins slid backwards in said slots, said stopper member disengaging from said front edge when said pins slide forward in said slots whereupon said linkages fall to a lowered position and said linkages engage said catcher members, and a retention bar extending from said linkages across the front of a shelf.

9. The shelf guard as defined by claim 8 wherein said retention bar is aligned with an upper shelf in said raised position whereupon said shelf guard does not interface with use of the guarded shelf.

10. The shelf guard as defined by claim 8 wherein said support brackets include hooks for engaging slotted holes in upright shelf supports.

11. The shelf guard as defined by claim 8 wherein said support brackets include holes for attaching said support brackets to shelf supports by means of screw fasteners.

12. The shelf guard as defined by claim 8 wherein said support brackets are attachable to an adjacent shelf.

13. The shelf guard as defined by claim 8 wherein said linkages and said retention bar are separate elements.

14. The shelf guard as defined by claim 7 wherein said linkages and said retention bar are integral.

15. The guard as defined by claim 1 wherein said linkages and retention bar are manually pivotable to a lowered position.

16. The guard as defined by claim 15 wherein said linkages and retention bar are pivotable to a lowered position in response to shaking.

17. The shelf guard as defined by claim 8 wherein said linkages are manually movable to said lowered position.

18. The shelf guard as defined by claim 17 wherein said linkages are movable to said lowered position in response to shaking.

* * * * *